US006626383B1

(12) United States Patent
Campbell

(10) Patent No.: US 6,626,383 B1
(45) Date of Patent: Sep. 30, 2003

(54) DEVICE FOR BREAKING, TEARING, AND CRUSHING THROUGH PLANT MATERIAL

(76) Inventor: James S. Campbell, 74 Sleepy Hollow La., Orinda, CA (US) 94563-1321

( * ) Notice: Subject to any disclaimer, the term of this patent is extended or adjusted under 35 U.S.C. 154(b) by 0 days.

(21) Appl. No.: 09/898,925

(22) Filed: Jan. 16, 2002

(51) Int. Cl.[7] ..... B02C 18/06

(52) U.S. Cl. ..... 241/236; 241/293

(58) Field of Search ..... 241/236, 293, 241/294, 295

(56) References Cited

U.S. PATENT DOCUMENTS 4,923,130 A * 5/1990 Campbell ..... 241/236

* cited by examiner

*Primary Examiner*—Mark Rosenbaum
(74) *Attorney, Agent, or Firm*—Charles L. Thoeming

(57) ABSTRACT

An improved device for crushing plant material and including contra-rotating rotors comprising a core member with an equal number of not less than three and not more than six blades tangentially disposed thereon.at equal degree angle orientation with each adjacent blade, said blades having flat sides and flat distal end surfaces disposed at substantially 90 degree angles to said sides and interconnected thereto along sharp edges, wherein optimal blade length, optimal positive rake angle, optimal blade thickness, and optimal unsupported blade length are presented.

9 Claims, 10 Drawing Sheets

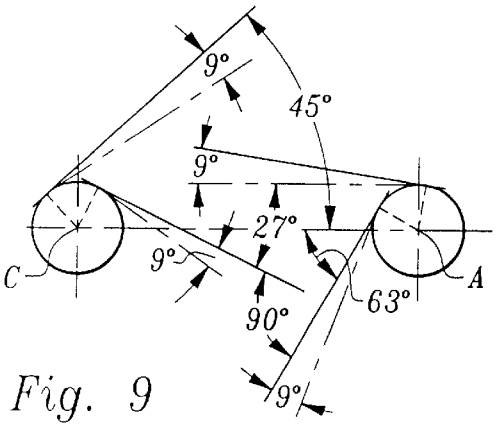
Fig. 9
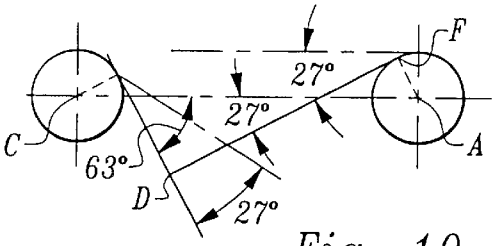
Fig. 10
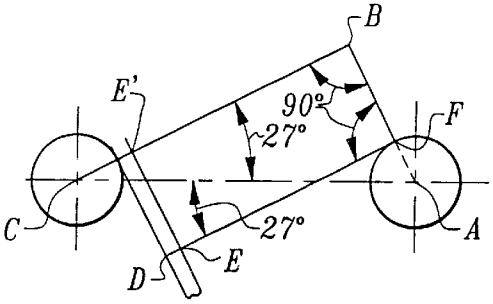
Fig. 11
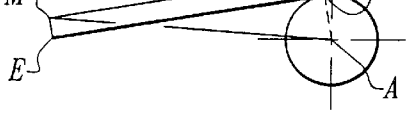
Fig. 12
Fig. 13
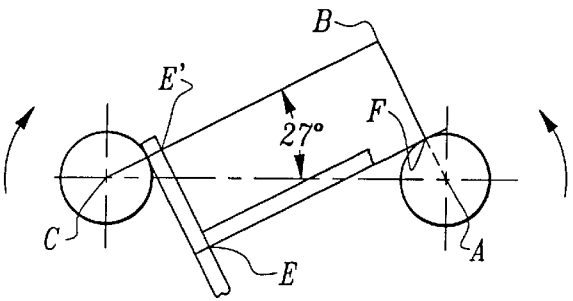
Fig. 14
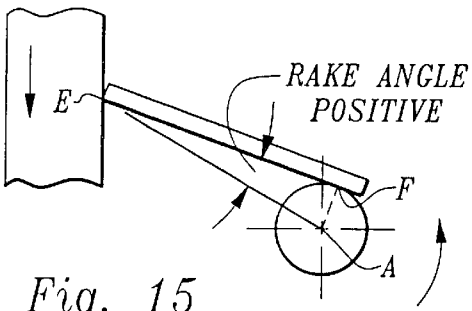
Fig. 15

DEVICE FOR BREAKING, TEARING, AND CRUSHING THROUGH PLANT MATERIAL

TECHNICAL FIELD

This invention relates to apparatus which is adapted to break, tear, and crush through plant materials such as branches, cuttings or the like. After passing through the apparatus the plant material is in a condition for disposal, including use of such material as compost.

BACKGROUND OF THE INVENTION

My U.S. Pat. No. 3,735,933, issued May 29, 1973, discloses an apparatus for the disposal of cuttings or the like which is adapted to break, tear and to crush through such cuttings to prepare the same for composting. The apparatus of this prior patent utilizes a pair of adjacent, generally parallel contra-rotating rotors. Each of the rotors has circumferentially-spaced blades at a rake angle in the direction of rotation, with the blades of one rotor overlapping those of the other rotor during rotation. In U.S. Pat. No. 3,735,933, each rotor includes at least 12 blades disposed at a rake angle of about 20 degrees.

My U.S. Pat. No. 4,923,130, issued May 8, 1990, discloses an apparatus for the disposal of cuttings or the like which is adapted to break, tear and to crush through such cuttings to prepare the same for composting. The apparatus of this prior patent utilizes a pair of adjacent, generally parallel contra-rotating rotors. Each of the rotors has blades tangentially disposed thereon at a rake angle in the direction of rotation, with the blades of one rotor overlapping those of the other rotor during rotation. The blades of this prior patent have flat sides and flat distal end surfaces disposed at substantially 90 degree angles to said sides and interconnected thereto along sharp edges. In U.S. Pat. No. 4,923,130 each rotor includes at least 6 blades disposed at a rake angle of about 23 degrees.

DISCLOSURE OF INVENTION

The present invention also relates to apparatus for the disposal of cuttings or the like utilizing a pair of adjacent, generally parallel, contra-rotating rotors to break, tear and to crush through plant material. The apparatus constructed in accordance with the teachings of the present invention, however, incorporates several novel features which contribute to the efficiency and effectiveness of the apparatus as compared with that disclosed in U.S. Pat. Nos. 3,735,933 and 4,923,130.

As given in the previous patents, I had arrived at and used successfully the rotors shown in FIG. 2. However I actually did not know much about how and why they functioned. Recently I have attempted to investigate and analyze my rotors and in particular their blades. I wanted to learn what would happen if I varied a variable. This patent will describe the results of my investigative analysis.

In review, the three important functions of my rotors can be stated as given below:

1. To take hold of, or grasp, the ends of branches which are fed into them;
2. To break, tear, crush through or otherwise produce small piece of wood, rapidly, suitable for composting or other purposes; and
3. To eject these small wood pieces, rapidly, toward a convenient direction. For my present machine this direction is downward, often into boxes.

The operation of my rotors may be further described as being low RPM (revolutions per minute) and high torque. The RPM of the preferred embodiment of the present invention is about 150.

In particular, the present invention includes improved, lower blade-to-rotor ratios which lower the production costs of the rotors while also improving efficiency or effectiveness of the operation of the apparatus. The rotors of the present invention have three, four, five or six blades where the old rotors had 6 blades or more. The angles between adjacent blades of the present invention are 120 degrees for three blade rotors, 90 degrees for four blade rotors, 72 degrees for five blade rotors, and 60 degrees for the improved six blade rotors. Accordingly, the amount of wood material becoming jammed or wedged between adjacent blades is greatly reduced by the present invention embodiment of four and five blade rotors over the prior art.

The improved rotor and blade configuration of the present invention also provides superior function for grasping and feeding plant materials into the apparatus. Prior art rotors contributed to materials fed into the apparatus being thrown upward and out of the apparatus instead of feeding through the rotors.

The improved rotor and blade configuration of the present invention also provides superior crushing through and opening up of the wood fed through them, thus increasing the biomass surface area for improved composting. The new apparatus is particularly adaptable to industrial applications in preparing biomass for further chemical processing, for example to produce ethanol.

Testing indicates the new three, four, five and six blade per rotor configurations increase the crushing effect on plant materials being fed through them to an optimum of six, eight, ten, or twelve times per rotor rotation.

Other features, advantages, and objects of the present invention will become apparent with reference to the following description and accompanying drawings.

These together with other objects of the invention, along with the various features of novelty which characterize the invention, are described with particularity in the claims attached to and forming a part of this disclosure. For a better understanding of the invention, its operating advantages and the specific objects attained by its uses, reference should be made to the attached drawings and descriptive materials in which there are illustrated preferred embodiments of the invention.

BRIEF DESCRIPTION OF DRAWINGS

These and other features, aspects, and advantages of the present invention will become better understood with regard to the following description, appended claims, and accompanying drawings as further described.

FIG. 9 is used for calculations. From the starting position shown in FIG. 8, the two rotors are rotated backward 9 degrees.

FIG. 10 is used for calculations. From the starting position in FIG. 8, the two rotors are rotated forward 27 degrees.

FIG. 11 is used for calculations such as for blade length.

FIG. 12 is used for calculations and it is a continuation of FIG. 11, to obtain blade length.

FIG. 13 is used for calculations for the blade length from shaft center to the furthermost outward point on a blade.

FIG. 14 is used for calculations for the location on the side of a blade where the blade closest position occurs.

FIG. 15 is used for calculations of the rake angle.

BEST MODE FOR CARRYING OUT THE INVENTION

The detailed description, as set forth below, in connection with the appended drawings is intended as a description of the construction and operation of the preferred embodiment of the invention, and is not intended to represent the only form in which the present invention may be constructed or operated. It is to be understood that the invention may be practiced by other different embodiments, which are also encompassed within the spirit and scope of the invention.

My branch crunching machines operate with two parallel rotors on which blades extend outward. The parallel rotors are mounted on parallel shafts which are connected together by two equal diameter spur gears. When one shaft rotates in one direction, the other shaft also rotates but in the opposite direction. The blades on one rotor will enter spaces between adjacent blades on the other rotor and come close enough to the sides of blades on the other rotor so that wood material passing between them is broken, torn and crushed through and thereby separated into pieces. Each rotor operates with the other rotor in the same manner so that what is described here for one rotor also is the same for the other rotor. A blade on one rotor must approach, enter the space between adjacent blades of the opposite rotor and come close to the side of the blade of the other rotor in order to break, tear and crush through the wood material. A manufacturing drawing of the new improved rotors of this present invention is depicted in FIGS. 1A and 1B.

Rotor diameter measurement is designated by the distance between the centerlines of the two parallel shafts, upon which the rotors are located. For my present invention consumer scale applications, this measurement is 3.5 inches. For commercial scale applications of my present invention, this measurement is 4.0 inches. It is critical that this distance, or centerline measurement between the two parallel shafts, equal the pitch diameter of the spur gears used to rotate the shafts. Spur gears with a pitch diameter of 4.0 inches are readily available in all sizes. Gear tooth size, or strength, is designated by diametral pitch. For example, consumer applications of the prior art use 8-pitch gears. The present invention, however, uses 6-pitch gears for the commercial applications because 6-pitch gears have larger and stronger teeth. With 6-pitch gears and a centerline distance between shafts of 4.0 inches, each gear will have 24 teeth.

Figure 1A:
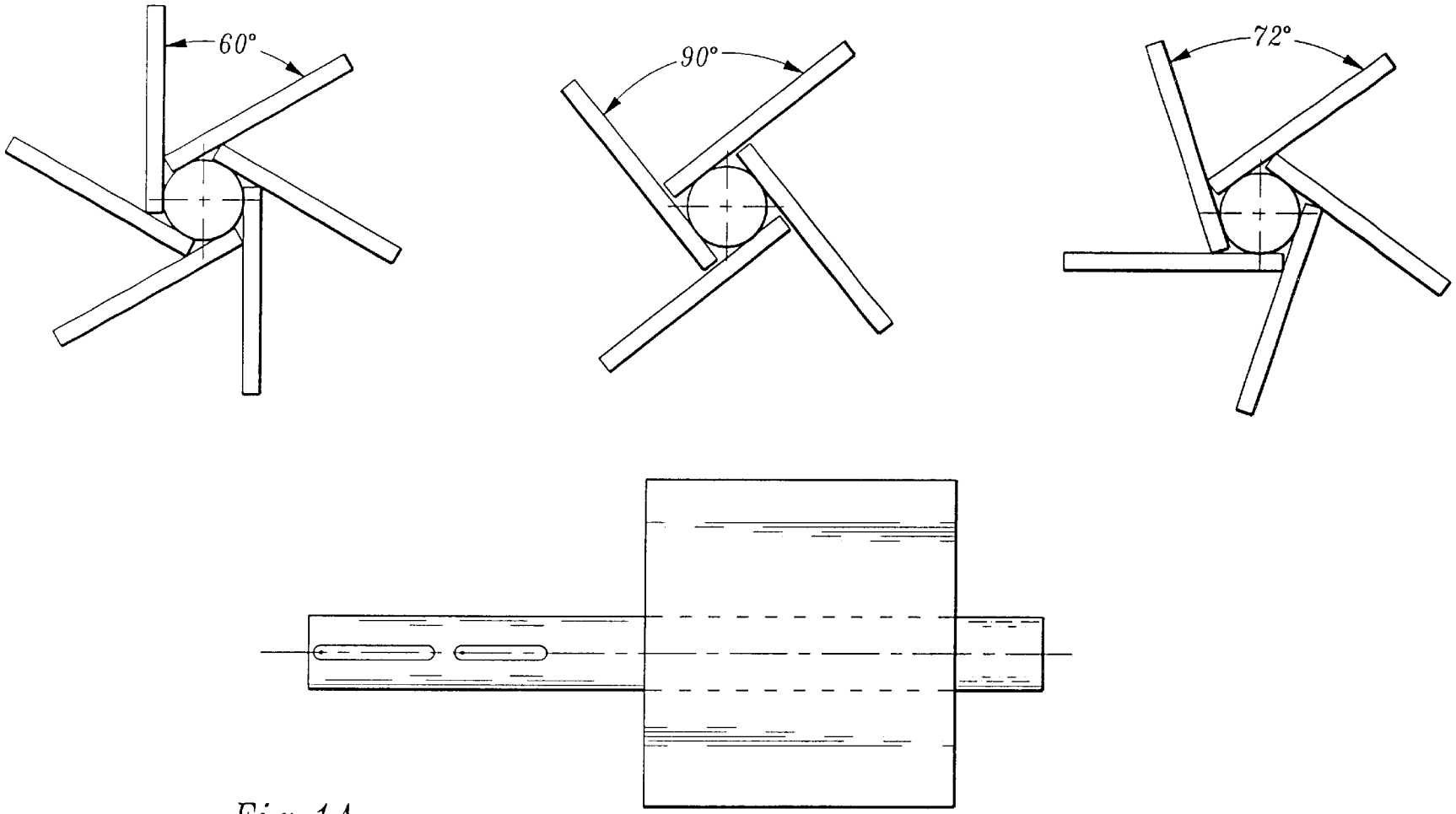
FIG. 1A is a combined side view and end view of a long shaft rotor with four, five and six blade configurations.
Figure 1B:
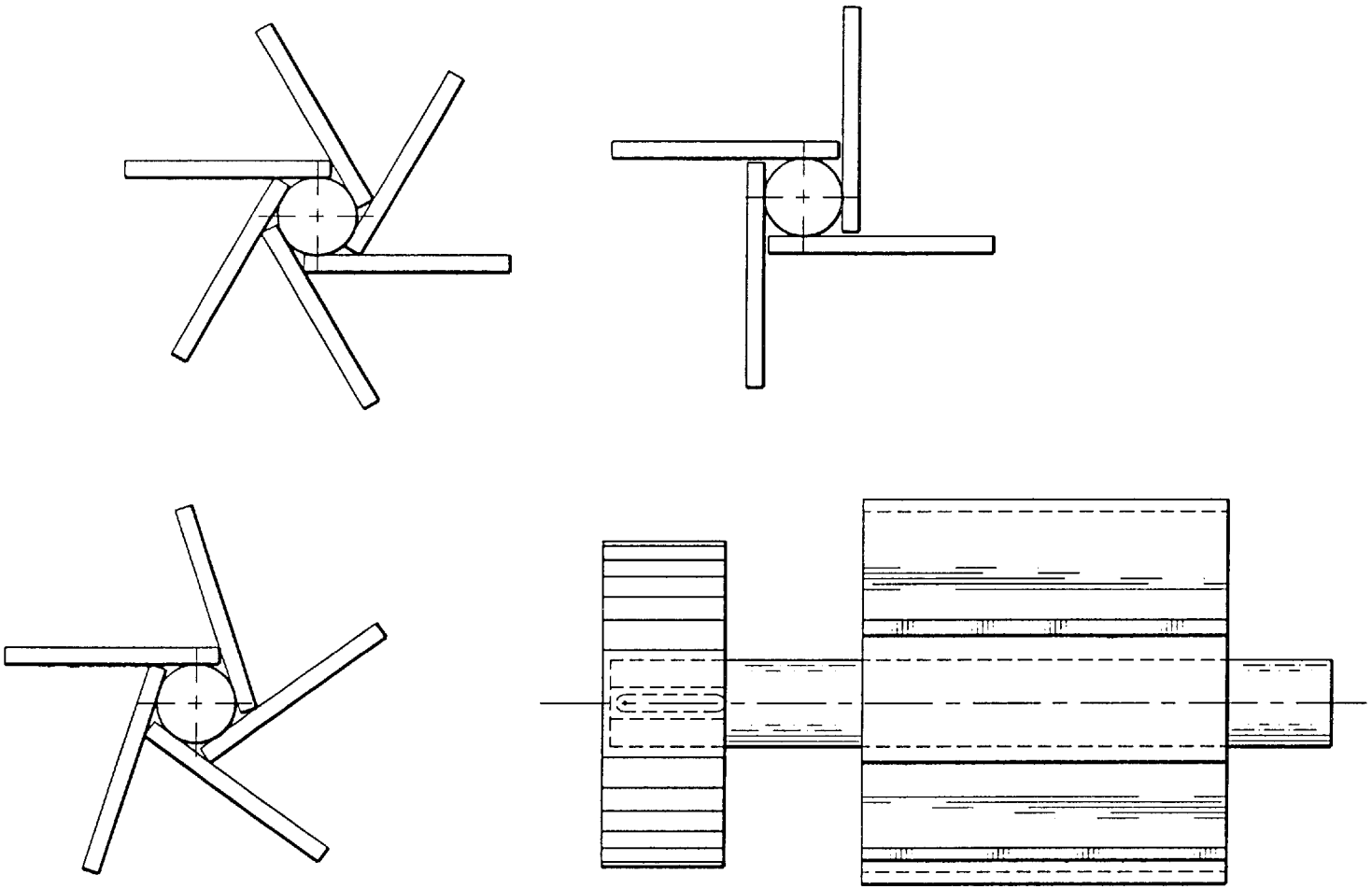
FIG. 1B is a combined side view and end view of a short shaft rotor with four, five and six blade configurations.

The design of the four, five and six blade rotors of the present invention is depicted in FIGS. 1A and 1B. The shaft diameter is one inch. Thrust washers may be used to constrain movements of the rotors axially, or in the direction parallel to the rotational axis. The smaller number of blades, three, four, or five, of the present invention facilitates use of a smaller diameter tangent circle which is the shaft diameter. The tubular spacers have been eliminated. The blades of a rotor are welded on tangent to the shaft surface. Table 1 shows values of the variables of the rotors for both the new and old rotors.

TABLE 1

| Rotor Variable | New Rotor | Old Rotor |
|---|---|---|
| Number of blades | 4, 5 or 6 | 6 |
| Tangent circle diameter, inches | 1 | 1 3/4 |
| Blade thickness, inches | 3/16 | 3/16 |
| Distance between axes of rotation, inches | 3 ½ | 3 ½ |

From the four variables shown, it is now possible to calculate the lengths of the blades. Blade length is the distance to which the blade extends outward. Blade length is in the radial direction. During operation, the outer end of each blade crushes through the wood material into the space between adjacent blades and against the side of a blade on the other rotor. Wood material is crushed between the outer end of one rotor blade and the side of a blade on the other rotor. The outer end of a rotor blade should approach and come sufficiently close to the other rotor blade side in order to separate the wood material into separate pieces. This intentional clearance between the rotor blades at this closest location may be from about 0.005 inch to about 0.030 inch. This closest location between the two blades is one dimension which is included in determining the blade lengths. These blades, one on each rotor, should not touch during operation. If they do touch, they will produce an undesirable noise. If they do touch, the outer end location of the blade can be shortened by grinding with a hand-held grinder. This grinding is facilitated by the fact that the outer ends of the rotor blades are square, or at 90 degrees to the blade sides.

The drawings and calculations which follow will be for rotors with five (5) blades. Similar drawings and calculations also have been made for rotors with three (3), four (4), and six (6) blades.

Figure 8:
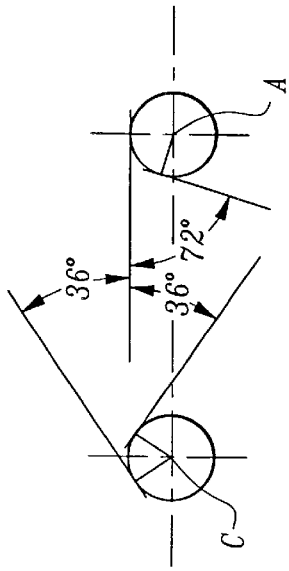
FIG. 8 is used for calculations. It shows the starting position for the 5-blade rotors.
Figure 4:
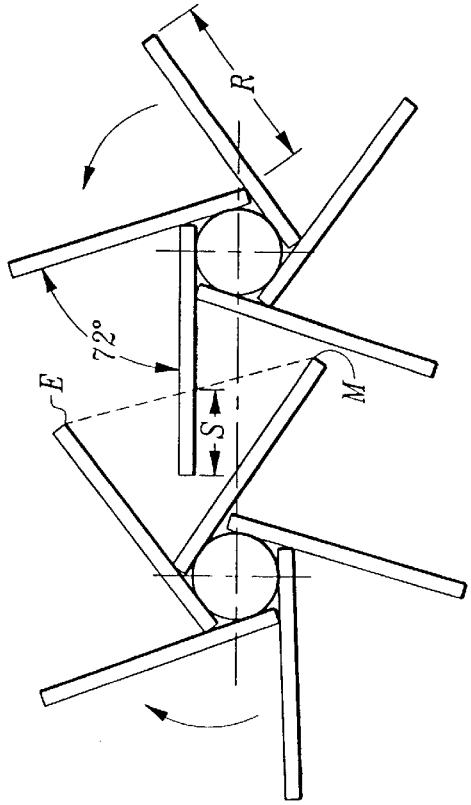
FIG. 4 is a cross-sectional view of the new five blade rotors.
Figure 6A:
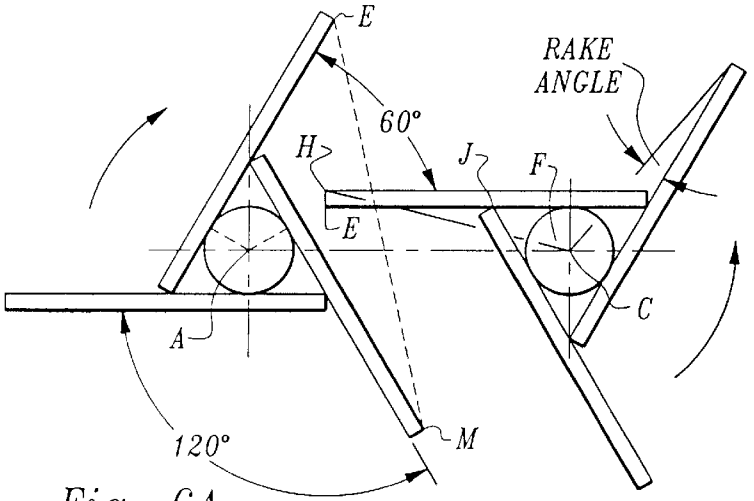
FIG. 6A is a cross-sectional view of the new three blade rotors.
Figure 6B:
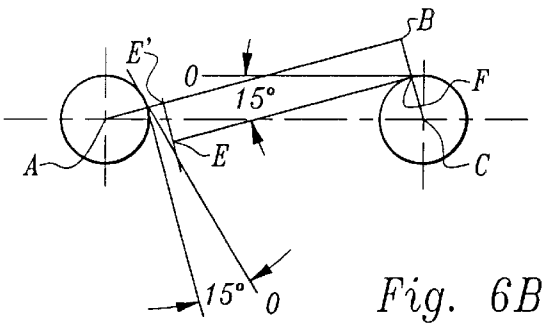
FIGS. 6B and 6C are used for calculations.
Figure 6C:
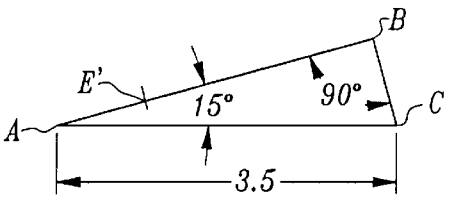

For rotors with five (5) blades, 360 degrees is divided by 5 giving the angle, 72 degrees, which is the angle between adjacent blades on a rotor. On each rotor the blades are equally spaced. Next, the starting position for the two rotors is as shown in FIGS. 4 and 8. In the starting position for all rotors, a blade on the right hand rotor is drawn to be parallel to the line connecting the shaft centers. For the left hand rotors, two blades are drawn with half of the angle between them (in this case 36 degrees) above the line representing the blade on the right hand rotor and half of the angle (36 degrees) below that line. In other words, the angular position of one rotor is offset from that of the other rotor by 36 degrees. A blade on one rotor is at the center of the blade space of the opposite rotor. The rotors are geared together so that when one rotor is rotated, the other rotor also rotates but in the opposite direction. As shown, the tangent circles, which are actually end views of the shafts are drawn with centers 3.5 inches apart. In many cases, blades are conveniently shown as single lines which are tangent to the shafts (the tangent circles). These single lines represent the inner surfaces of the blades.

FIG. 9 shows the rotors, starting in FIG. 8, rotated backwards 9 degrees. This 9 degrees may be a guess, but it will be checked to see if it is correct. In the closest position for two blades, or when the end of one blade is closest to the side of the opposite blade, it will be verified that the two blades are perpendicular (90 degrees from each other). Next take the triangle obtained by the two blades which cross the line between the shaft centers. Before rotating 9 degrees backwards the two angles obtained by the crossings of the line between shaft centers were 36 and 72 degrees. After rotating 9 degrees backwards, these two angles change to 27 and 63 degrees, respectively. These lines with the line between the shaft centers form a triangle. We know that three interior angles of a triangle add up to 180 degrees. Within the triangle adding 27 and 63 degrees equals 90 degrees. Therefore the other angle equals 90 degrees and the blades are in their closest position. This is verified in FIG. 7D.

It is observed here that the blade surfaces on the two blades which approach each other for the final crushing and compressing the wood material are parallel. The entire width of the blade outer end is parallel to the side of the blade of the other rotor.

Next, in FIG. 10 the above will be accomplished differently. From the starting position, shown in FIG. 8, the rotors will be rotated forward 27 degrees as shown in FIG. 10. Using the same calculation as given above, the blades again are found to be perpendicular. From FIGS. 9 and 10 the following has been verified.

1. For every 36 degrees of rotor rotation, a blade closest position for the final crushing occurs. During one complete revolution of the rotors, a blade closest position occurs 10 times.

2. From a blade closest position such as that obtained by rotating the rotors backwards 9 degrees, a blade closest position occurs every 36 degrees from that position.

3. Alternately, a blade end on one rotor will enter the blade space on the other rotor. During that time, the blade end will come to the blade closest position.

Figure 2B:
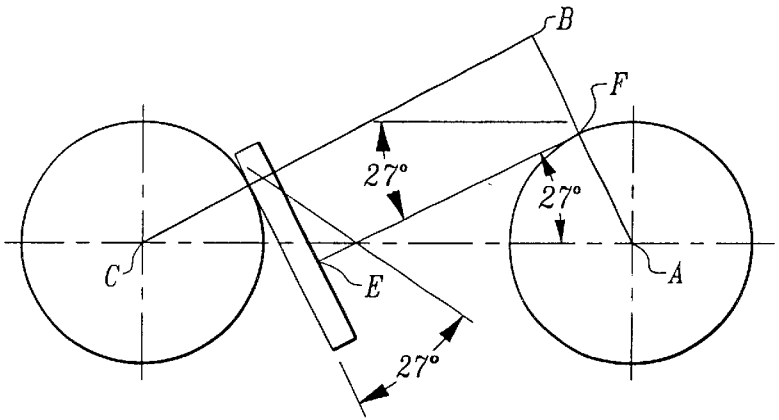
FIG. 2B and FIG. 2C are used in calculations such as for blade length.
Figure 2C:
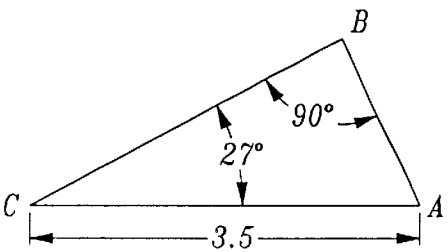
Figure 2A:
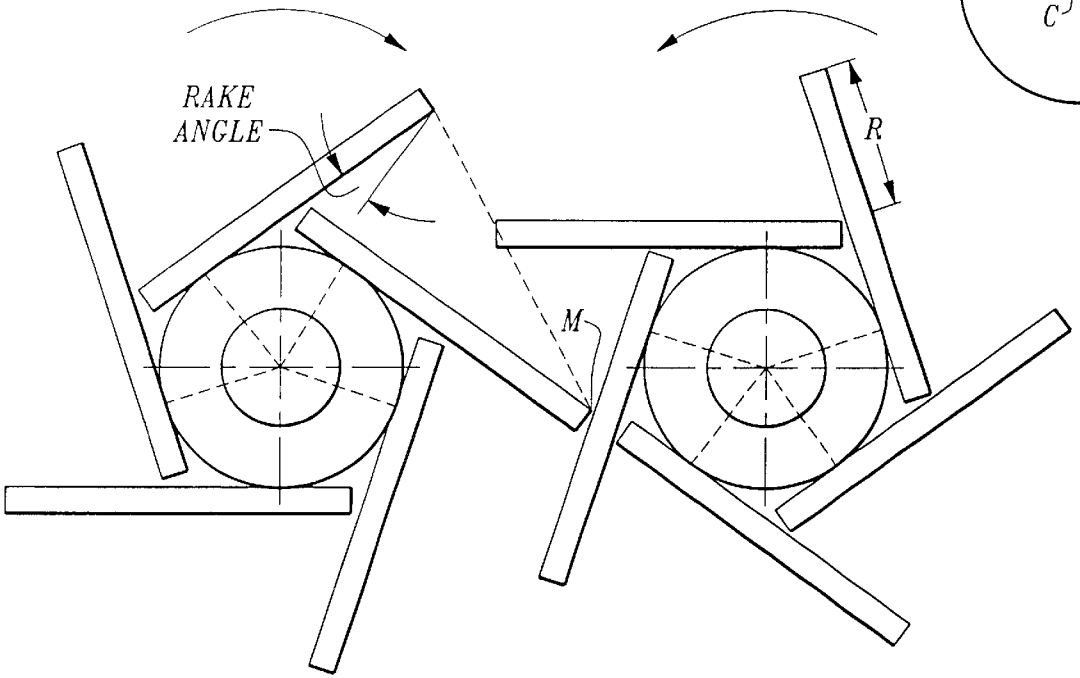
FIG. 2A is cross-sectional view of the previous rotors, before this patent except that here the rotor has been drawn with five blades. The tubular spacers are shown.
Figure 3A:
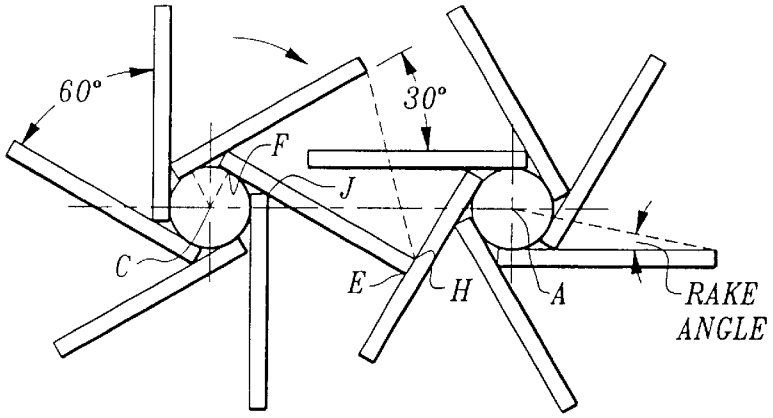
FIG. 3A is a cross-sectional view of the new six blade rotors.
Figure 3B:
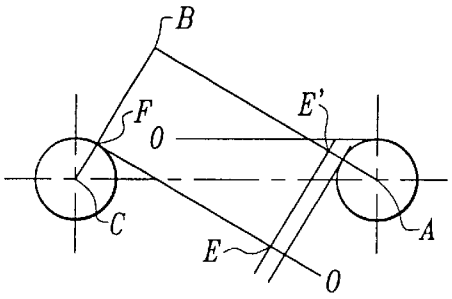
FIGS. 3B and 3C are used for calculations.
Figure 3C:
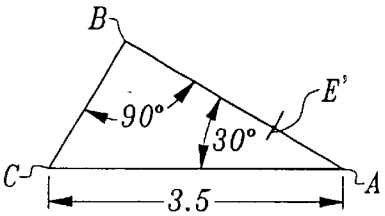
Figure 4A:
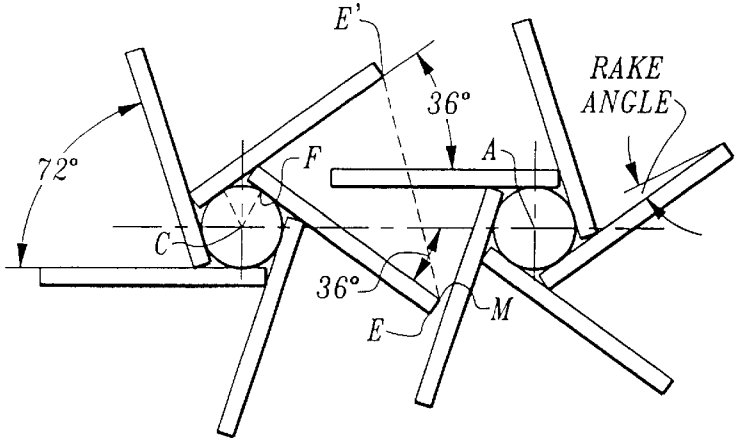
FIGS. 4A, 4B and 4C are used for calculations.
Figure 4B:
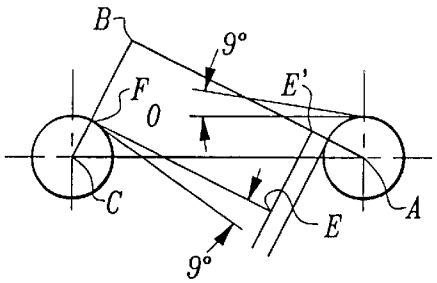
Figure 4C:
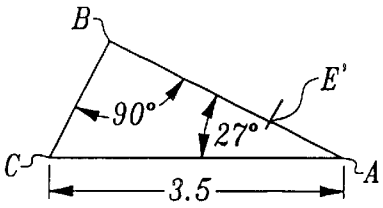

Blade length can now be expressed in different ways as the length from the point of tangency to the blade outer end, or the length from the axis of rotation out to the furthermost point outward on the blade or as the unsupported blade length, shown as "R" in FIGS. 4 and 2A. Each rotor has a central welded-together steel solid portion resembling a core. This core consists of blades welded to the shaft and to other blades. The unsupported length portion of the blade starts where the blade leaves the central core and extends outward by itself as a cantilever beam.

In FIG. 10, a triangle has been obtained with internal angles, 27, 63 and 90 degrees. Similar to this triangle, another triangle is drawn with the hypotenuse made equal to length CA, or to 3.5 inches. The angles are not changed and the triangles are similar. FIG. 11 shows the triangle, CAB. The angle at B equals 90 degrees and that at C equals 27 degrees. With this triangle, in FIG. 12, the length CB is found.

Cosine 27 degrees=CB/3.5; CB=0.891×3.5=3.119 inches

The blade length from the point of tangency=EF, in FIG. 11, $$EF = CB - CE' = 3.119 - \left(\frac{1}{2} + 3/16 + .005\right)$$
$$= 3.119 - .693 = 2.426 \text{ inches.}$$

This is the length of the blade outward from the point of tangency (point F).

The blade length from the shaft center outward to the furthermost point in a blade is found with the use of the drawing, FIG. 13. This blade length is the length AM.

$$MN=EF;\ AN=\tfrac{1}{2}+\tfrac{3}{16}=0.688$$

$$\overline{AM}^2=\overline{MN}^2+\overline{AN}^2=\overline{2.4262}^2+\overline{0.6882}^2$$

$$AM=\sqrt{5885+0.473}=2.522 \text{ inches.}$$

Thus, the blade length from the shaft center outward to the furthermost point on a blade equals 2.522 inches. The location on the side of a blade where a blade closest position occurs preferably should be close to the central core of the rotor. Thus, the central core can give support to the blade near the location to resist the force of the final crushing. This location is found with the use of FIG. 14. This force on the side of a blade occurs throughout a distance of 3/16 inch, the blade thickness. The outer end of this force width, 3/16 inch, measured from the point of tangency is located at a distance EE' from the point of tangency. The inner end of the force width is located at distance EE'−3/16 inch from the point of tangency. Using FIGS. 11 and 14, the calculation is as follows:

$$EE'=FB=AB-\tfrac{1}{2} \text{ inch}$$

$$\text{Sine 27 degrees}=AB/AC=AB/3.5;$$

$$AB=3.5\times0.454=1.589$$

$$EE'=AB-\tfrac{1}{2}=1.589-0.5=1.089 \text{ inches}$$

Thus, 1.089 inches is the distance to the outer end of the force width from the point of tangency. The distance to the inner end of the force width from the point of tangency equals $$EE'-\tfrac{3}{16}=1.089-0.188=0.901 \text{ inch}$$

In comparisons among the various blade configurations, the distance 1.089 is used.

For the calculations of the rake angle, FIG. 15 is used. Rake angle can be defined as the angle between a radial line from the shaft center to the point of contact and the side of the blade. Thus:

$$\textit{rake angle} = \tan^{-1}\frac{AF}{EF} = \tan^{-1}\frac{.5}{2.426} = \tan^{-1}.206 = 11.64 \text{ degrees.}$$

Figure 5C:
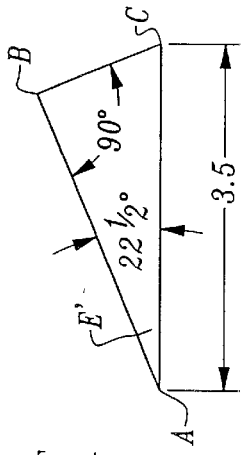
FIGS. 5B and 5C are used for calculations.
Figure 5B:
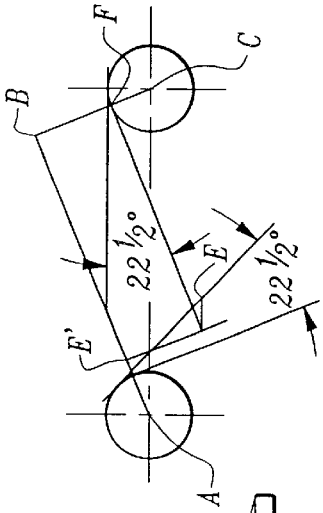
Figure 5A:
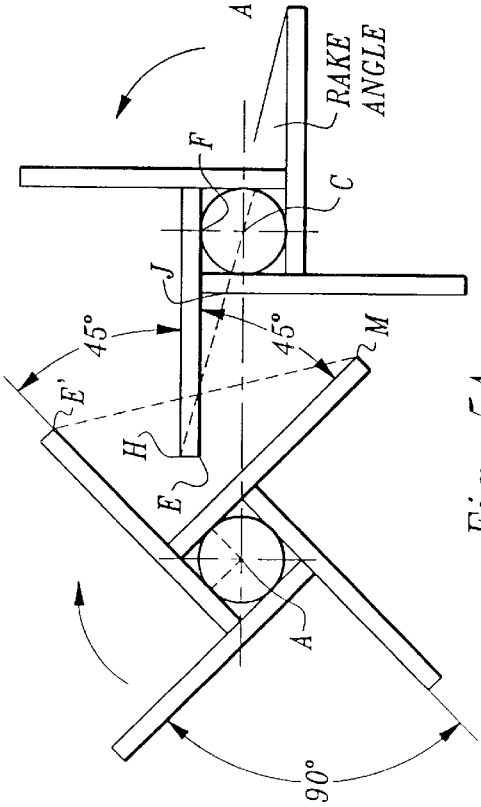
FIG. 5A is a cross-sectional view of the new four blade rotors.

FIG. 7 shows the design from FIG. 4 with the two rotors rotating together through small angular movements of 9 degrees. This 9 degree movement was chosen in order to obtain a blade closest position, shown at FIG. 7D. FIGS. 17A through 17*g* do the same as FIG. 7 for the four blade rotors shown in FIG. 5A. In FIGS. 17A through 17*g* the two rotors are rotated together through small angular movements of 5⅝ degrees. Then a blade closest position is obtained at FIG. 17E.

Figure 7A:
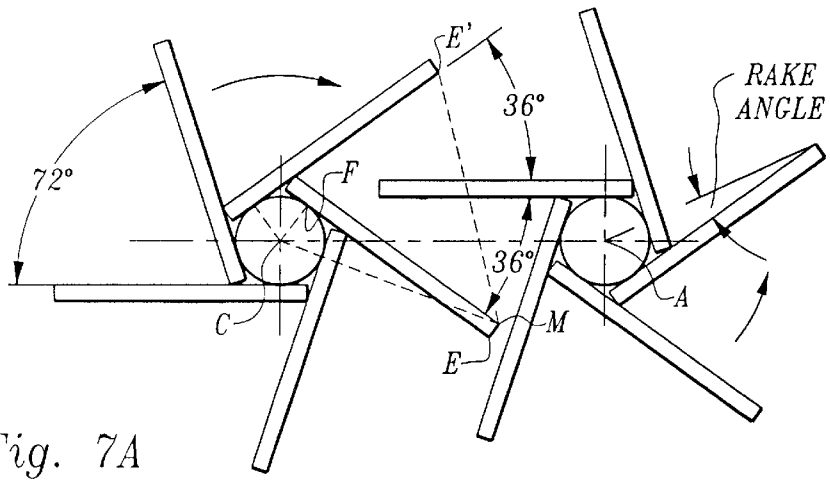
FIGS. 7A to FIG. 7G are a series of cross-sectional views of the interaction of the dual 5-blade rotors through angular increments of 9 degrees.
Figure 7B:
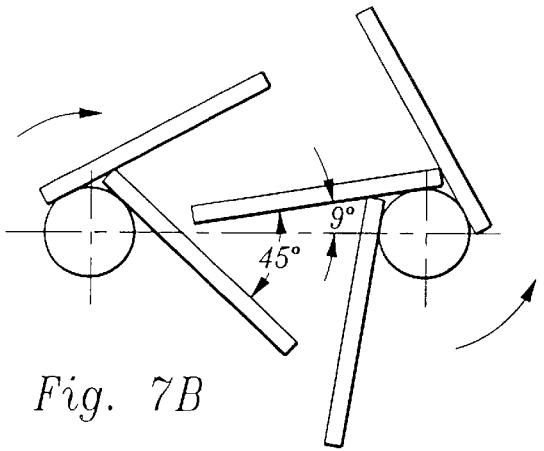
Figure 7C:
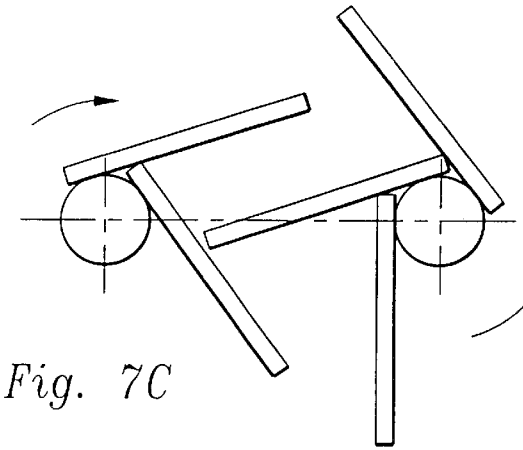
Figure 7D:
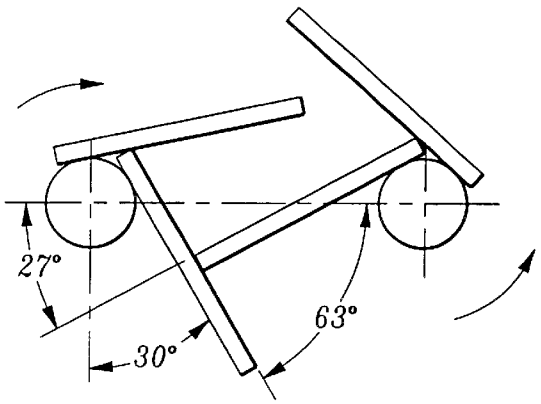
Figure 7E:
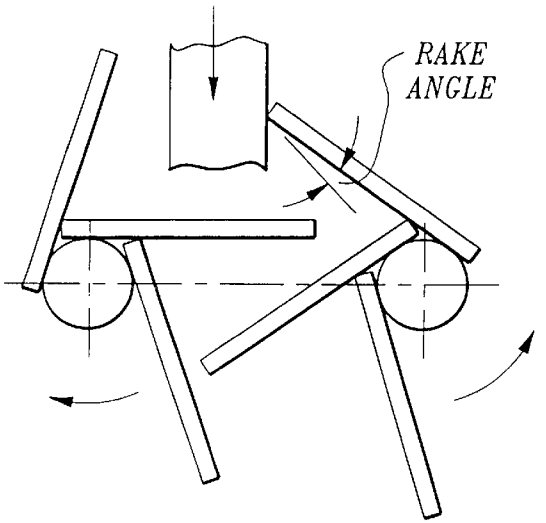
Figure 7F:
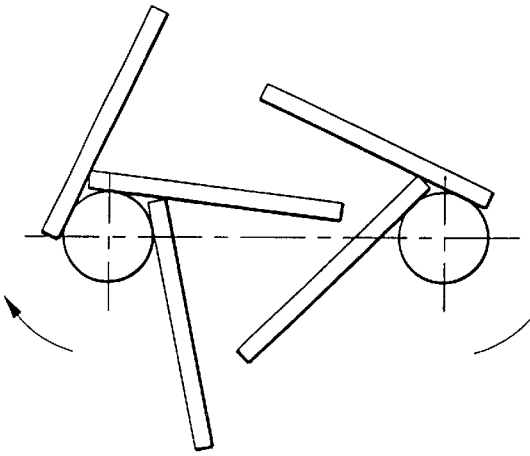
Figure 7G:
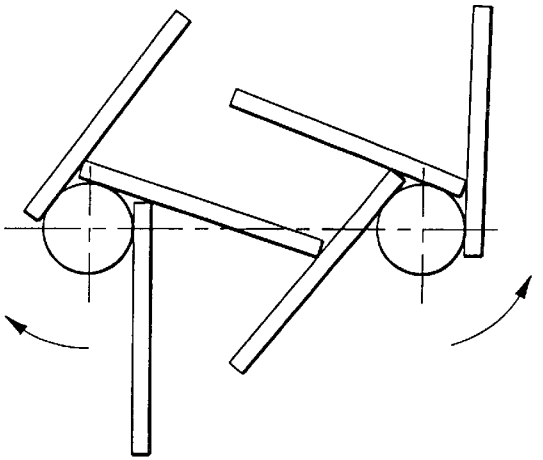

FIG. 7E illustrates how the rotor blades actually grasp the outer surface of a branch. As shown, it is the leading edge of the outer end of a blade which bites in and grasps a branch. In the previous patent, U.S. Pat. No. 4,923,130, rake angle was mentioned. The present invention illustrates how rake angle at the leading blade edge helps make it easier for the blade leading edge to enter, or bite, into the wood surface during grasping. In this present design we have a positive rake angle by welding blades tangent to the shaft surface. This provides sufficient positive rake angle.

In FIG. 7D, the end of a blade of the right hand rotor is closest to the side of a blade on the left hand rotor. The closest position for these two blades is when they are perpendicular. In manufacture, an intentional clearance between two corresponding blades is made to be from about 0.005 inch to 0.030 inch without touching. This is where maximum crushing of the wood fiber material occurs. The complete width of the end of the blade, equal to the blade thickness, becomes parallel to the side surface of the blade on the other rotor. Crushing at its closest point occurs between the two parallel surfaces. It should be noted that the forces on the blade end and blade side during final crushing are favorably located. For example, at its outer end the blade force causes only compression in the unsupported blade length. On the side of the corresponding blade of the other rotor, the forces are located close to where they are well supported. To analyze the grasping of a branch by a blade, refer to FIG. 7E. Here the leading 90 degree edge of the blade's outer end contacts the surface of a branch. The direction of the force exerted by the blade edge upon the branch surface is in a circular path about the center of rotation of the shaft. Since the ends of the blades move in different directions, the wood passing between the rotors is torn.

Figure 16A:
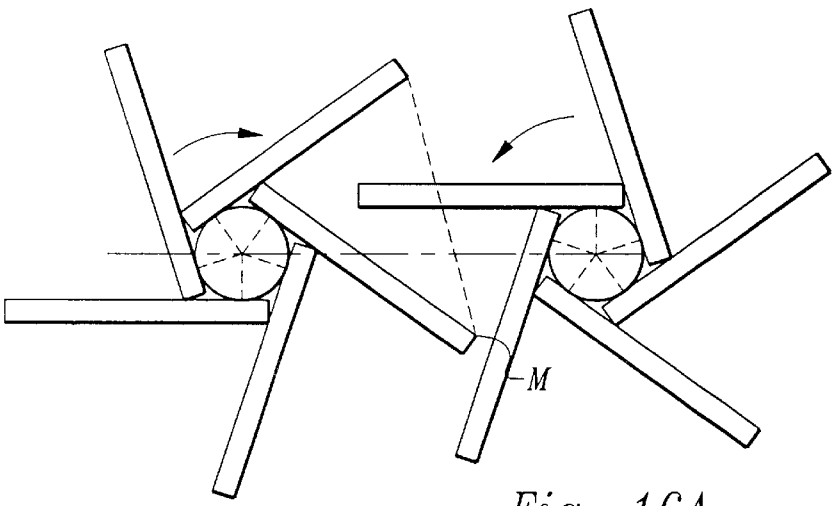
FIG. 16A to FIG. 16C are cross-sectional views and calculations for the rotor and blade dimensions for an industrial application of the present invention.
Figure 16B:
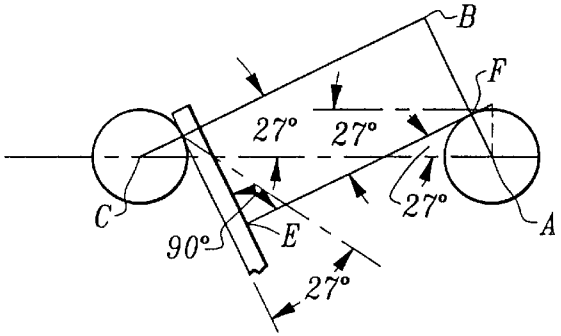
Figure 16C:
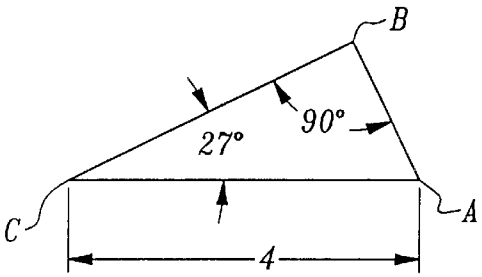
Figure 17A:
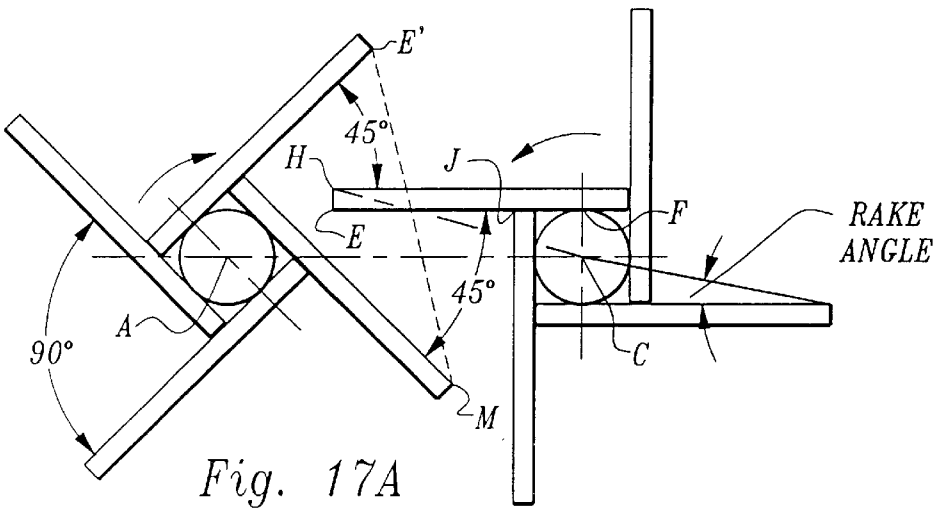
FIG. 17A to FIG. 17G are a series of cross-sectional views of the interaction of the dual 4-blade rotors through angular movements of 5⅝ degrees.
Figure 17B:
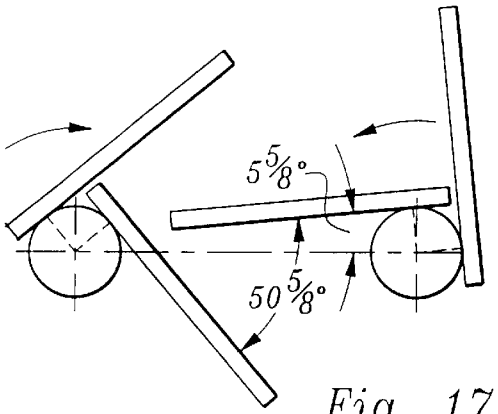
Figure 17C:
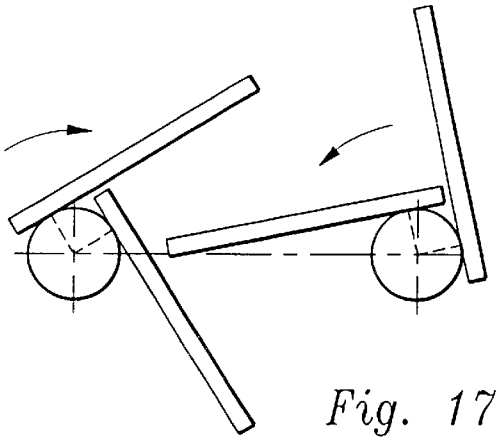
Figure 17D:
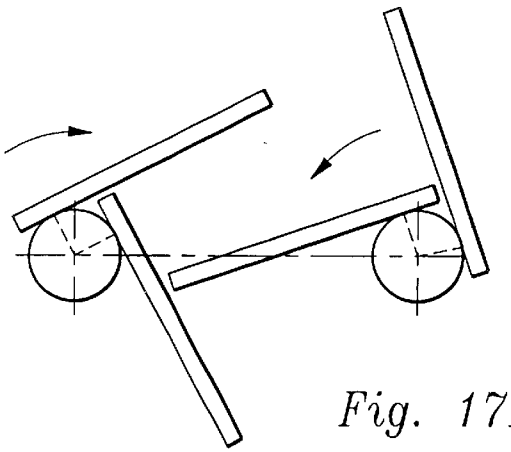
Figure 17E:
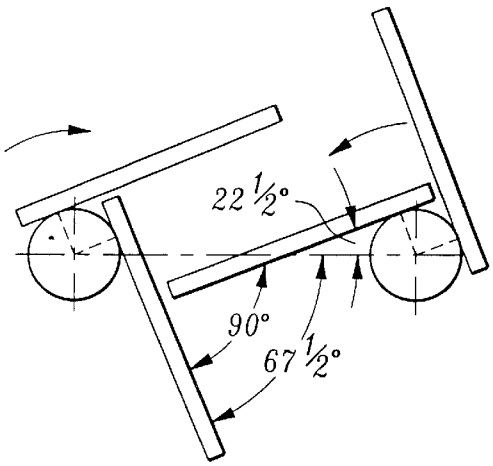
Figure 17F:
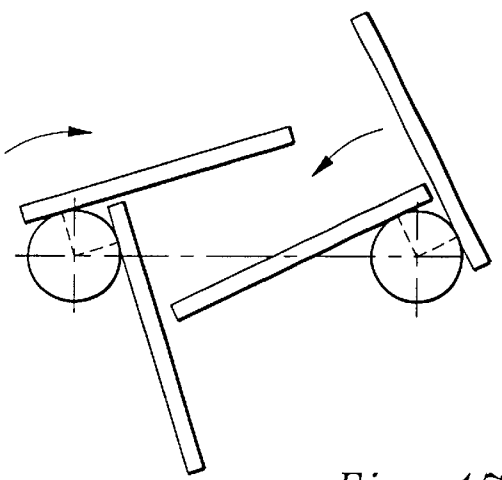
Figure 17G:
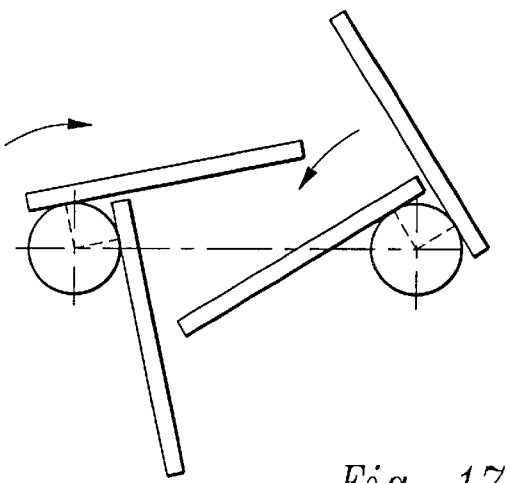

For a new and larger volume machine for commercial or industrial purposes, the design shown in FIGS. 16A, B, and C is recommended. Here the distances between the centers of the two parallel shafts has been increased to 4.0 inches.

The results of the calculations for the new 3, 4, 5 and 6 blade rotors have been tabulated in Table 2. Calculations for the previous rotors of the previous patent are also included. The previous rotors had 6 blades, but here we have changed the previous rotors to have 5 blades in order to help in making comparisons. An important design change from the previous rotors has been the reduction of the tangent circle diameter to 1 inch from 1¾ inches. The tubular spacers have been eliminated. The other important change has been reducing the number of blades on the rotors from 6 down to 5, 4, or 3. Six blade rotors when compared with 4 blade rotors produce, during operation, smaller pieces of wood. Field testing has demonstrated that the 5 blade rotors appear to provide optimal operational results. Three blade rotors were investigated but it is believed they will not become competitive.

In the testing of the new rotors I have observed that the new rotors appear to operate more effectively and efficiently. Also the machine does not stall, or stop operation, as often with larger diameter branches. The grasping of the ends of branches, I believe is improved. To explore and find reasons for this improved functioning, first refer to results in Table 2.

TABLE 2

| | ON THE DRAWINGS | NEW ROTORS, THIS PATENT | | | | PREVIOUS PATENT ROTORS |
|---|---|---|---|---|---|---|
| NUMBER OF BLADES ON ROTOR | | 3 | 4 | 5 | 6 | 6 |
| BLADE LENGTH FROM POINT OF TANGENCY, INCHES | EF | 2.688 | 2.541 | 2.426 | 2.388 | 2.051 |
| BLADE LENGTH, SHAFT CENTER FURTHER, INCHES | AM | 2.775 | 2.632 | 2.522 | 2.437 | 2.310 |
| BLADE LENGTH, UNSUPPORTED, INCHES | R | 1 29/32 | 1 11/16 | 1 7/8 | 1 15/16 | 1 1/16 |
| CLOSEST POSITION - POINT OF TANGENCY, INCHES | EE' | 0.405 | 0.841 | 1.089 | 1.25 | 0.741 |
| RAKE ANGLE, DEGREES | FIG. 15 | 10.54 | 11.13 | 11.65 | 11.83 | 23 |
| BLADE END ENTRANCE INTO SPACE BETWEEN BLADES - OPPOSITE ROTOR, INCHES | S | 17/32 | 11/16 | 7/8 | 1 | 0 |

In Table 2 it can be seen that all blade lengths of the new rotors, presented in this patent, are longer compared with those of the previous rotors and patent. Since the distance between shaft centers is unchanged at 3.5 inches, this means that blades on a rotor overlap further into spaces between adjacent blades of the opposite rotor. This can be observed by comparing FIGS. 2A and 4. A dashed line connecting points E and M has been drawn between the two outer ends of the triangular shaped space between the two adjacent blades. This has been done with the rotors in their starting positions, as shown in FIG. 8. Then, the distance to which the ends of the blades have entered the triangular shaped space is measured as "S". The results of these measurements, with a scale, have been entered into Table 2. With the previous rotors with the tangent circle diameter equal to 1¾ inch, the ends of the blades do not enter the triangular space at the starting position. With the new 5 blade rotors, the ends of the blades enter the opposite spaces between adjacent blades a distance S which equals ⅞ inch. The shapes of these triangular spaces between adjacent blades on the rotors appear to be better on the new rotors. The triangular spaces on the new rotors are deeper. With the new rotors, a branch will be crushed further into a deeper space between adjacent blades.

Another important reason for completely eliminating the tubular spacers is the lowering of manufacturing costs. Reducing the number of blades on a rotor also considerably reduces manufacturing costs.

From Table 2 it can be seen that blade lengths have been increased by eliminating the tubular spacers, or reducing the tangent circle diameter. It can also be observed that blade length is also increased as the number of blades on a rotor is decreased. With respect to the above description then, it is to be realized that the optimum dimensional relationships for the components of the invention, to include variations in size, materials, shape, form, function and manner of operation, assembly, manufacture, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Additionally, since numerous modifications and changes will readily occur to those skilled in the art, it is not desired to limit the invention to the exact construction and operation shown and described, and further, all suitable modifications and equivalents may be resorted to, falling within the scope of the invention.

I claim:

1. A kit for installation on a device for breaking, tearing, and crushing through plant material to improve the efficiency of the device comprising, in combination:

a pair of cylindrically-shaped rotors, rotatably mounted on the device's existing parallel shafts connected together by existing equal diameter spur gears in a contra-direction, parallel axial orientation with each other defining an operational space between the axes of rotation of each rotor, each rotor further comprising a central welded-together steel solid core member further defining a tangent circle;

each core member having an equal number of not less than three and not more than six blades projecting outwardly from the core member into the space between the blades of the other core member, wherein each blade further comprises a defined angle between adjacent blades, a positive rake angle, spaced flat sides, a blade thickness, an overall blade length, an unsupported blade length, a blade length from the point of tangency, and a distal end, the distal end having a flat surface disposed at 90 degree angles to the flat sides and interconnected to the flat sides along sharp edges; and wherein the centerline distance between the shafts equals the pitch diameter of the spur gears used to rotate the shafts.

2. The kit of claim 1 wherein the number of blades on each core member equals three, and wherein the defined angle between adjacent blades equals 120 degrees, the positive rake angle equals 10.54 degrees, the blade thickness equals 3/16 of an inch, the overall blade length equals 2.775 inches, the unsupported blade length equals 1 29/32 inches, and the blade length from the point of tangency equals 2.688 inches.

3. The kit of claim 1 wherein the number of blades on each core member equals four, and wherein the defined angle between adjacent blades equals 90 degrees, the positive rake angle equals 11.13 degrees, the blade thickness equals 3/16 of an inch, the overall blade length equals 2.632 inches, the unsupported blade length equals 1 11/16 inches, and the blade length from the point of tangency equals 2.541 inches.

4. The kit of claim 1 wherein the number of blades on each core member equals five, and wherein the defined angle between adjacent blades equals 72 degrees, the positive rake angle equals 11.65 degrees, the blade thickness equals 3/16 of an inch, the overall blade length equals 2.522 inches, the unsupported blade length equals 1 7/8 inches, and the blade length from the point of tangency equals 2.426 inches.

5. The kit of claim 1 wherein the number of blades on each core member equals six, and wherein the defined angle between adjacent blades equals 60 degrees, the positive rake angle equals 11.83 degrees, the blade thickness equals 3/16 of an inch, the overall blade length equals 2.437 inches, the unsupported blade length equals 1 15/16 inches, and the blade length from the point of tangency equals 2.388 inches.

6. Improved rotors for installation on existing apparatus for breaking, tearing, and crushing through plant material comprising:

a pair of cylindrically-shaped rotors, rotatably mounted in a contra-direction, parallel axial orientation with each other defining an operational space between the axes of rotation of each rotor, each rotor further comprising a central welded-together steel solid core member further defining a tangent circle;

each core member having three blades projecting outwardly from the core member into the space between the blades of the other core member, wherein each blade further comprises a defined angle which equals 120 degrees between adjacent blades, a positive rake angle which equals 10.54 degrees, spaced flat sides, a blade thickness which equals 3/16 of an inch, an overall blade length which equals 2.775 inches, an unsupported blade length which equals 1 29/32 inches, a blade length from the point of tangency which equals 2.688 inches, and a distal end, the distal end having a flat surface disposed at 90 degree angles to the flat sides and interconnected to the flat sides along sharp edges; and wherein the centerline distance between the shafts equals the pitch diameter of the spur gears used to rotate the shafts.

7. Improved rotors for installation on existing apparatus for breaking, tearing, and crushing through plant material comprising:

a pair of cylindrically-shaped rotors, rotatably mounted in a contra-direction, parallel axial orientation with each other defining an operational space between the axes of rotation of each rotor, each rotor further comprising a central welded-together steel solid core member further defining a tangent circle;

each core member having four blades projecting outwardly from the core member into the space between the blades of the other core member, wherein each blade further comprises a defined angle which equals 90 degrees between adjacent blades, a positive rake angle which equals 1 1.13 degrees, spaced flat sides, a blade thickness which equals 3/16 of an inch, an overall blade length which equals 2.632 inches, an unsupported blade length which equals 1 11/16 inches, a blade length from the point of tangency which equals 2.541 inches, and a distal end, the distal end having a flat surface disposed at 90 degree angles to the flat sides and interconnected to the flat sides along sharp edges; and wherein the centerline distance between the shafts equals the pitch diameter of the spur gears used to rotate the shafts.

8. Improved rotors for installation on existing apparatus for breaking, tearing, and crushing through plant material comprising:

a pair of cylindrically-shaped rotors, rotatably mounted in a contra-direction, parallel axial orientation with each other defining an operational space between the axes of rotation of each rotor, each rotor further comprising a central welded-together steel solid core member further defining a tangent circle;

each core member having five blades projecting outwardly from the core member into the space between the blades of the other core member, wherein each blade further comprises a defined angle which equals 72 degrees between adjacent blades, a positive rake angle which equals 11.65 degrees, spaced flat sides, a blade thickness which equals 3/16 of an inch, an overall blade length which equals 2.522 inches, an unsupported blade length which equals 1 7/8 inches, a blade length from the point of tangency which equals 2.426 inches, and a distal end, the distal end having a flat surface disposed at 90 degree angles to the flat sides and interconnected to the flat sides along sharp edges; and wherein the centerline distance between the shafts equals the pitch diameter of the spur gears used to rotate the shafts.

9. Improved rotors for installation on existing apparatus for breaking, tearing, and crushing through plant material comprising:

a pair of cylindrically-shaped rotors, rotatably mounted in a contra-direction, parallel axial orientation with each other defining an operational space between the axes of rotation of each rotor, each rotor further comprising a central welded-together steel solid core member further defining a tangent circle;

each core member having six blades projecting outwardly from the-core member into the space between the blades of the other core member, wherein each blade further comprises a defined angle which equals 60 degrees between adjacent blades, a positive rake angle which equals 11.83 degrees, spaced flat sides, a blade thickness which equals 3/16 of an inch, an overall blade length which equals 2.437 inches, an unsupported blade length which equals 1 15/16 inches, a blade length from the point of tangency which equals 2.388 inches, and a distal end, the distal end having a flat surface disposed at 90 degree angles to the flat sides and interconnected to the flat sides along sharp edges; and wherein the centerline distance between the shafts equals the pitch diameter of the spur gears used to rotate the shafts.

* * * * *